US007641001B2

(12) United States Patent
Mash

(10) Patent No.: US 7,641,001 B2
(45) Date of Patent: Jan. 5, 2010

(54) AUGER

(76) Inventor: Thomas B. Mash, 4507 Hillview Rd., Knoxville, TN (US) 37919

( * ) Notice: Subject to any disclaimer, the term of this patent is extended or adjusted under 35 U.S.C. 154(b) by 109 days.

(21) Appl. No.: 11/698,598

(22) Filed: Jan. 26, 2007

(65) Prior Publication Data

US 2008/0179101 A1 Jul. 31, 2008

(51) Int. Cl.
*E21B 10/44* (2006.01)

(52) U.S. Cl. ..... 175/323; 175/394

(58) Field of Classification Search ..... 175/323, 175/394

See application file for complete search history.

(56) References Cited

U.S. PATENT DOCUMENTS

| | | | | |
|---|---|---|---|---|
| 1,993,365 | A | 3/1935 | Englebright et al. | |
| 2,221,680 | A | 11/1940 | Parrish | |
| 2,962,066 | A * | 11/1960 | Deliso | 408/226 |
| 3,057,647 | A * | 10/1962 | Wood | 403/2 |
| 3,178,210 | A * | 4/1965 | Dickinson | 403/292 |
| 3,710,877 | A | 1/1973 | Michasiw | |
| 5,487,432 | A | 1/1996 | Thompson | |
| 5,782,310 | A | 7/1998 | Lange | |
| 6,089,334 | A | 7/2000 | Watts | |
| 6,161,631 | A | 12/2000 | Kennedy et al. | |
| 6,168,350 | B1 | 1/2001 | Bartlett | |
| 6,283,231 | B1 | 9/2001 | Coelus | |
| 6,308,789 | B1 | 10/2001 | Kuenzi et al. | |
| 6,681,871 | B2 | 1/2004 | Drumm et al. | |

* cited by examiner

*Primary Examiner*—Jennifer H Gay
*Assistant Examiner*—Elizabeth C Gottlieb
(74) *Attorney, Agent, or Firm*—Jason H. Foster; Kremblas, Foster, Phillips & Pollick

(57) ABSTRACT

A tool for boring has an axle for drivingly linking at a first end to a portable rotatable machine. At a second end, the axle has a shaft-receiving bore into which a nose shaft is inserted. The nose has a cutting tip and a flight cutter that aligns with a flight on the axle. An insulator is electrically interposed between the cutting tip and the nose shaft, thereby electrically insulating the nose shaft from the cutting tip. The flight cutter performs the high-wear cutting at the leading edge of the flight, thereby causing the flight to merely remove the soil or other particulate from the hole being formed.

11 Claims, 4 Drawing Sheets

AUGER

BACKGROUND OF THE INVENTION

1. Field of the Invention

This invention relates generally to tools, and more particularly to earth-drilling augers used for boring through particulate material, such as soil.

2. Description of the Related Art

Forming a hole in particulate material, such as soil or sand, especially under a surface structure, such as a sidewalk or a building foundation, is commonly effected by a screw-like tool called an auger, which progressively bores or drills into the material. The typical auger has a cutting blade at the distal end of a helical flight that is mounted to an axle. The axle extends longitudinally away from the user, or a rotatable machine, and defines an axis of rotation for the auger's flights. The user rotates the auger, either by hand, or more preferably by machine, such as a drill. As the auger rotates, it removes particulate to form a hole, and conveys the particulate away from the hole by the action of the flights. The auger progressively forms the hole deeper and deeper as it cuts further and conveys particulate away. In some prior art references, additional sections of helically flighted axles can be coupled to the auger.

Some prior art augers and drilling tools that are designed for drilling into compacted earth, such as clay, combine pressurized air and working fluid with the auger for continuously loosening debris from the hole. The fluid and debris are channeled into an escape route sub-assembly system, which is typically a longitudinal hole through the axle. In this way, the hole is regularly flushed and kept relatively clean to enable the inner surface of the hole to be dissociated by the drilling action. However, such prior art drilling tools are bulky and awkward due to the attached pneumatic and hydraulic hoses. Thus, such devices are difficult to maneuver and operate, especially when they are used in narrow spaces. In addition, the escape route sub-assembly system can become clogged with debris, which can damage the tool and delay the progress. Also, fluid can leak from the escape route and soak the surrounding earth, and surface structures can be damaged by, or lose support from, that surrounding earth.

Some augers have been made with various types of fasteners for linking flighted modular sections together in series in order to bore a hole to a certain depth. Augers have also been formed with various cutting blades designed for enhancing the performance of the auger. For example, augers have been designed to be compact and portable in order to be transported and used to drill a hole in ice for ice fishing.

A more significant design in prior art augers involves a limitation to the distance that a helical flight extends along an axle. For example, U.S. Pat. No. 2,221,680 to Parrish teaches an auger having a discontinuous flight attached to the outer surface of the drilling axle. Sections of the flight have been removed from the drilling stem in order to reduce friction that is generated by the rotating land, which is the peripheral edge of the flight, contacting the newly formed sidewall of the hole. The frictional force resisting the rotation of the auger is reduced along the auger.

The prior art augers are not completely satisfactory for hole-forming operations, especially where the hole is to be substantially horizontal. An auger is needed with features designed to overcome the deficiencies that have been described.

BRIEF SUMMARY OF THE INVENTION

An improved boring tool is disclosed having an axle with an outer surface to which a radially inwardly facing edge of a helical flight is attached. An axle shaft is mounted at a first end of the axle for drivingly linking the axle to a portable rotatable machine, such as a drill. A shaft-receiving bore is formed at a second, opposite axle end to receive a shaft.

The improvement comprises a nose removably mounted at the second axle end. The nose comprises a multiple-sided nose shaft, such as a hexagonal shaft, extending into the shaft-receiving bore. The shaft-receiving bore has a complementary, multiple-sided sidewall for engaging the nose shaft, thereby drivingly linking the nose to the axle. A shaft-receiving bore that is hexagonally-shaped is complementary where the nose shaft is also hexagonally shaped. A cutting tip that has at least one blade is mounted to the nose shaft to first encounter the cutting medium.

A flight cutter is removably mounted to the nose shaft. The flight cutter has at least one blade, and preferably has two opposing blades. One of the blades aligns with a leading edge of the flight, thereby forming a cutting edge near one end of the flight. The flight cutter bears the majority of the wear of cutting, and is replaceable, thereby making maintenance relatively easy. The flight cutter preferably has an aperture formed between its two blades, and the aperture has a multiple-sided sidewall, such as a hexagonal sidewall, that engages the nose shaft sides, thereby drivingly linking the flight cutter to the nose shaft.

The tool preferably has a fastener, such as a screw, extending through the axle into the shaft-receiving bore and seating against the nose shaft, thereby retaining the nose shaft in the shaft-receiving bore. Other fasteners can be used and are contemplated. The tool preferably has electrical insulating means in the nose for electrically insulating the axle from the cutting tip and the flight cutter. Such insulating means protects the operator in case an electrical line is struck while boring.

It is contemplated that multiple sections of the tool will be attached together in modular fashion in order to make the tool as long as necessary. This can occur due to the fact that all shaft-receiving bores, and all shafts, are designed to be of complementary shape and size. Thus, all shafts can fit into all bores, and all fasteners can fasten the structure in which the bore is formed to the shaft.

Figure 1:
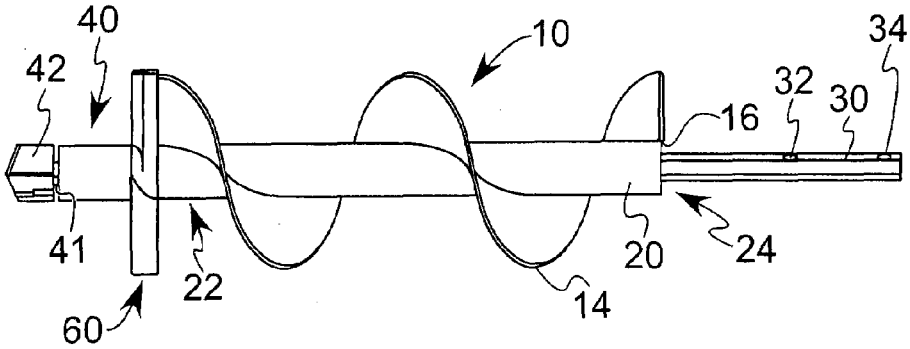
FIG. 1 is a side view illustrating the preferred embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

The auger tool 10, shown in FIG. 1, is for boring into soil or any other particulate material through which a passage needs to be formed and which can be cut by the tool. The tool 10 has an axle 20 around which a helical flight 14 is mounted, preferably by welding at the radially inwardly facing edge 16.

Figure 4:
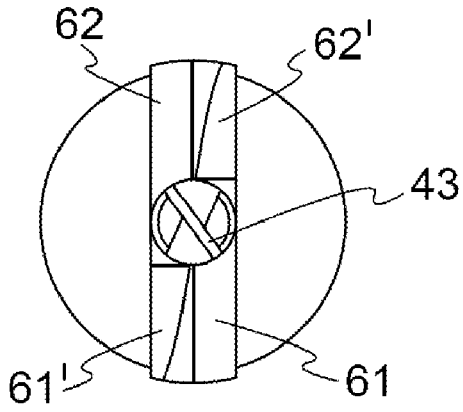
FIG. 4 is an end view illustrating the preferred embodiment of the present invention.
Figure 5:
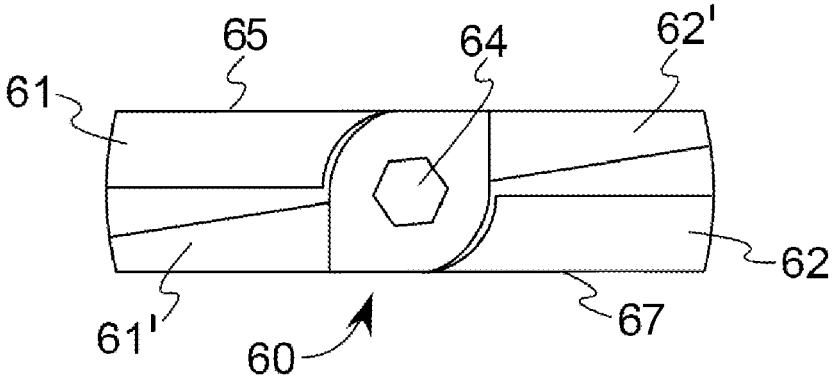
FIG. 5 is an end view illustrating the preferred flight cutter.
Figure 6:
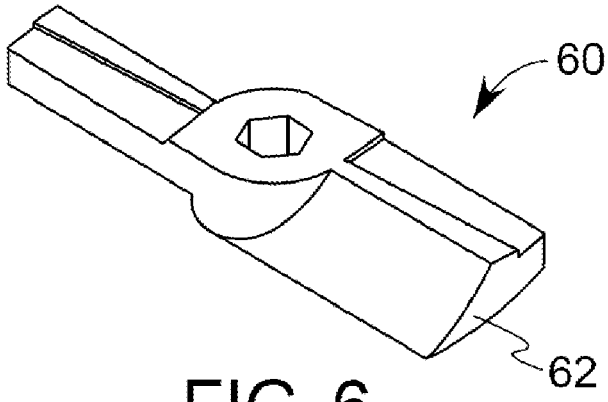
FIG. 6 is a view in perspective illustrating the flight cutter of FIG. 5.

The axle 20 is preferably a hollow tube having a first end 22, a second end 24, and a longitudinal axis that defines an axis of rotation, about which the tool 10 can be rotated in a hole-forming operation described below. The tool 10 and its components are made of steel or similar material commonly used for making construction tools, unless otherwise noted. It is preferred that the axle 20 is a length that has a relationship to the pitch of the helical flights, thereby causing the flight ends at the ends of the axle to align circumferentially. Thus, looking down the end of the axle 20, the two opposite ends of the flight 14 preferably begin and end at the same circumferential point, such as the 12 o'clock point when looking at FIG. 4.

Figure 12:
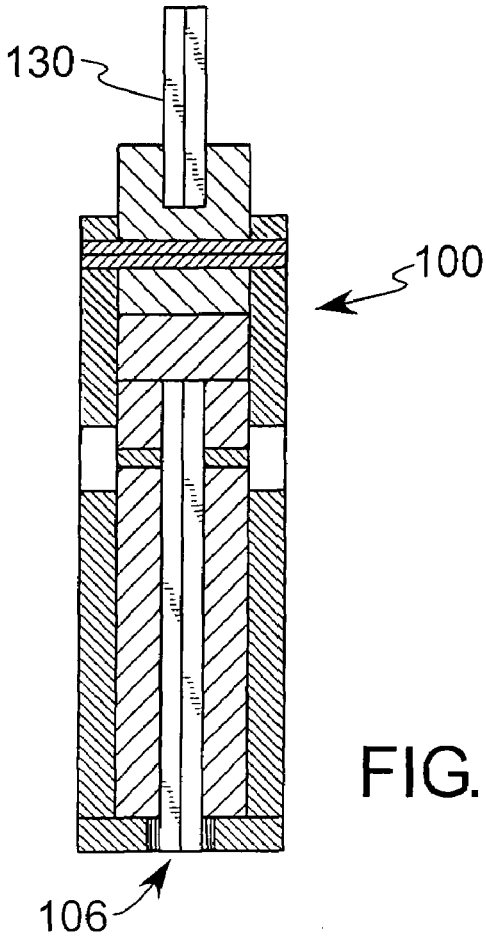
FIG. 12 is a side view in section illustrating a fitting for mounting to a drill or other rotary device.

The second end 24 of the axle 20 has an axle shaft 30 rigidly mounted thereto, such as by welding or press fitting the shaft 30 into the inner bore of the axle 20. The shaft 30 is a multiple sided structure, preferably a three, four, six or eight sided shaft, most preferably a six sided hexagonal shaft, that can be drivingly linked to a portable rotatable machine, such as an industrial drill (not shown), through a drive fitting 100, as illustrated in FIG. 12, which is configured to be mounted in the drill's "chuck" or clamping mechanism. The chuck of such a drill receives the shaft 130 in a conventional manner by tightening against it, thereby gripping the shaft 130 tightly. The shaft 30 of the axle is inserted into the shaft-receiving bore 106 at the opposite end of the fitting 100, and fixes thereto, such as by spring-loaded fasteners that seat against the shaft 30.

Figure 3:
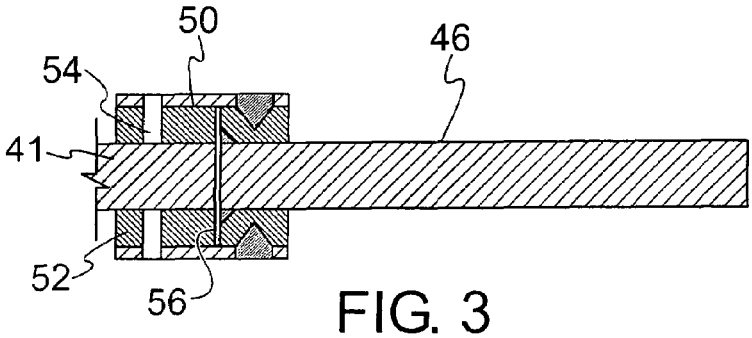
FIG. 3 is a side view in section illustrating a preferred nose.

A nose 40 is mounted to the first end of the axle 20, opposite the shaft 30. The nose 40 has a cutting tip 42, a flight cutter 60 and a shaft 46, as shown in FIG. 3. The cutting tip 42 is similar to a conventional router bit having a blade 43 (see FIG. 4) at one end and a cutting tip shaft 41 extending out of the opposite end. The shaft 41 is preferably also a multiple-sided shaft, such as a hexagonal shaft, that extends into the housing 50 as described further below.

The housing 50 is preferably a cylinder having a passage formed through it in which an insulating insert 52 is mounted. A bore is formed in the insert 52 that has a shape on its inwardly facing surface that is complementary to the shape of the outwardly facing surface of the cutting tip shaft 41, which is mounted in the bore. An insulating pin 54 extends through the housing 50 and an insulating insert 52 and extends either against or through the shaft 41, thereby inhibiting longitudinal movement of the shaft 41 relative to the insert 52.

An insulating plate 56 extends across the passage formed inside the housing 50 in which the insert 52 is mounted, and across the bore of the insert 52. The plate 56 is preferably a circular body that is flat, similar to a coin, and has electrical insulating properties. The shaft 46 extends into the bore of the insert 52, and is restricted from moving longitudinally by the plate 56 and the frictional grip of the inwardly facing surface of the insert 52 against the shaft 46. The plate 56 and the insert 52 are preferably nylon, but can be made of any other suitable electrically insulating material.

The flight cutter 60 (shown in FIGS. 1 and 4-6) has a pair of opposed blades 61 and 62 and a central aperture 64 through which the shaft 46 extends. The aperture 64 preferably has a hexagonally-shaped, inwardly facing sidewall that complements the hexagonally shaped shaft 46, so that the complementary surfaces not only align the flight cutter on the tool 10, but also maintain the blades 61 and 62 in the same position relative to the flight 14 during use by preventing relative rotation.

The blades 61 and 62 have sharp edges 65 and 67 to cut into the particulate material through which the tool 10 is intended to bore. The blades 61 and 62 have recesses 61' and 62' respectively, formed therein in the top surface of the flight cutter 60. An end of the flight 14 rests in one of the recesses due to the angular alignment between the aperture in the flight cutter and the shaft 46. The flight 14 resting in a recess of the flight cutter 60 is exposed to little of the wear to which the cutting surface is normally subject during use, since the flight cutter 60 cuts into and breaks up the material. The flight cutter 60 is preferably slightly larger in diameter (such as one-quarter inch) than the flight 14, thereby reducing drag of the flight against the sidewall of holes formed by the flight cutter 60.

The flight cutter 60, which is made of tool steel or another durable material and receives the majority of the wear, can be replaced easily when it is worn beyond its limit. Because the flight cutter 60 is interposed on the shaft 46 between the end of the axle 20 and the housing 50 of the nose 40, the flight cutter 60 can be replaced by simply removing the nose 40, sliding the flight cutter 60 off the shaft 46, and then placing a new or sharpened flight cutter on the shaft 46. The nose 40 is then reattached to the axle 20 as shown in FIG. 1.

Similarly, the cutting tip 42, which is at the tip of the tool 10 and is the first surface to puncture the soil or other particulate, can be replaced easily. The pin 54 is removed and the shaft 41 is displaced axially out of the insert 52. A new or sharpened cutting tip is then inserted in place of the tip 42, and the pin (or a replacement pin) is driven into the position shown in FIG. 3.

Because of the configuration of the nose 40, if the cutting tip 42 strikes an electrical line there is no electrically conductive path to the shaft 46. Therefore, there is no possibility for the operator of the boring device in which the tool 10 is mounted to be shocked or electrocuted unless he or she is in contact with the tip 42. This configuration reduces the possibility that the operator will be harmed. It is possible to use only the drive fitting 100, which has means for electrically insulating the shaft 130 from any shaft inserted into the bore 106, as described in U.S. Pat. No. 6,681,871 instead of the insulating means of the nose 40, or in addition to it. It is also contemplated to insulate the entire nose and flight cutter 60 by interposing a fitting similar to the fitting 100 between the nose and the axle 20. In this example (not shown), the flight cutter 60 is positioned as shown, and an extra flight cutter can be interposed between the insulator and the axle 100 to protect the flight end. The extra flight cutter can be angled approximately 90 degrees relative to the flight cutter 60 to provide extra stability.

The fitting 100 used alone provides electric shock protection for anyone holding the drill, but not for someone who contacts the axle 20 or flight 14. Thus, the insulating means in the nose 40 and/or the additional insulator interposed between the nose and the axle 20 provides electric shock protection from the point of contact with the electric line to the user. The radial path of conduction from the shaft 41 to the housing 50 is broken up by the pin 54 and the insert 52, and the longitudinal path of conduction is broken up by the plate 56, which separates the shaft 41 from the shaft 46.

Other means for electrically insulating the cutting tip 40 from the shaft 46 are contemplated. Other such means include the structures shown in U.S. Pat. No. 6,681,871 to Drumm et al, which is herein incorporated by reference. The preferred insulator is made of an electrically nonconductive material that is also rigid, such as nylon. The insulator is a safety feature, because the hole-forming operation is commonly performed near buried electrical wires. If a wire is struck, the insulator prevents electricity from flowing through the tool 10 and to the drill or other device that the user is holding or contacting.

Figure 2:
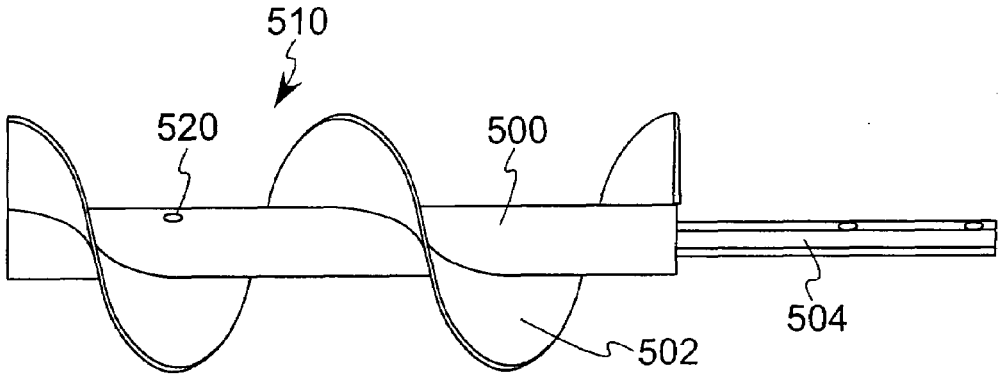
FIG. 2 is a side view illustrating an alternative structure that can be added to the tool in order to form longer holes.
Figure 7:
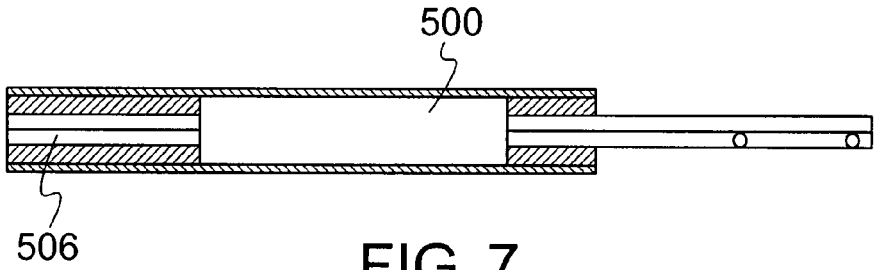
FIG. 7 is a side view in section illustrating the axle and shaft of the alternative structure shown in FIG. 2.

The tool 10 can be attached to one or more other substantially similar tool sections in order to increase the length of the boring device. Whereas the tool 10 is approximately 24 inches long, the effective boring length can be increased by attaching a similar structure 510 having an axle 500 with a flight 502 and a shaft 504 similar to the tool 10, as shown in FIG. 2. Such a structure 510 can be mounted to the tool 10 by inserting the shaft 30 into the shaft-receiving bore 506 formed in the axle 500, as shown in FIG. 7. A fastener, such as a screw 520, extends through the axle 500 sidewall and into the bore 506, seating against the shaft 30 of the tool 10. The shaft 30 has on one of its sides at least one, and preferably two, cavities 32 and 34, as shown in FIG. 1. The cavities 32 and 34 receive the ends of fasteners, when the tool 10 is used in conjunction with the structure 510, and restrict longitudinal movement of the shaft 30 relative to the axle 500. Similar screws (not shown) extend through the sidewall of the axle 20 to seat against the shaft 46 inserted into a shaft-receiving bore in the end of the axle 20 opposite the shaft 30.

The shaft 130 of the drive fitting 100 is preferably made of tool steel or some other hardened material to resist deformation under the force of the gripping chuck, and is preferably formed in a shape that will not fit into the shaft-receiving bores of the other components. This ensures that only the correct shaft 130 will be chucked in the drill. All other complementary shafts can fit into the shaft-receiving bore 106 of the fitting 100. These other shafts are preferably normal steel, and are not deformed by the forces encountered when inserted into a shaft-receiving bore, but would typically be deformed by a drill chuck. Thus, other than the shaft 130, all shafts can be inserted into all shaft-receiving bores, and alignment of the components is assured due to the precise angular alignment of the shafts with the bores' sidewalls.

Figure 8:
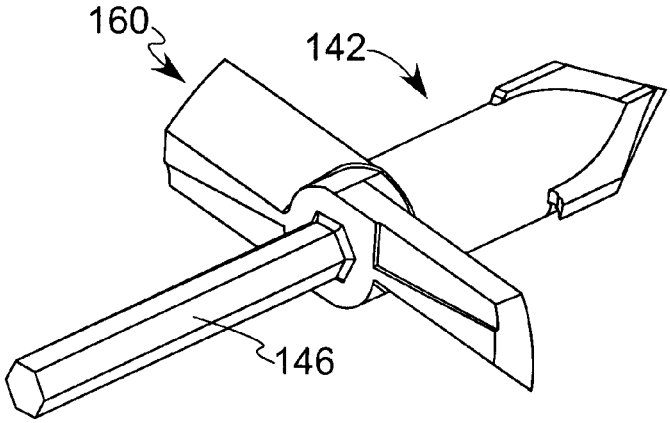
FIG. 8 is a view in perspective illustrating an alternative nose section.
Figure 9:
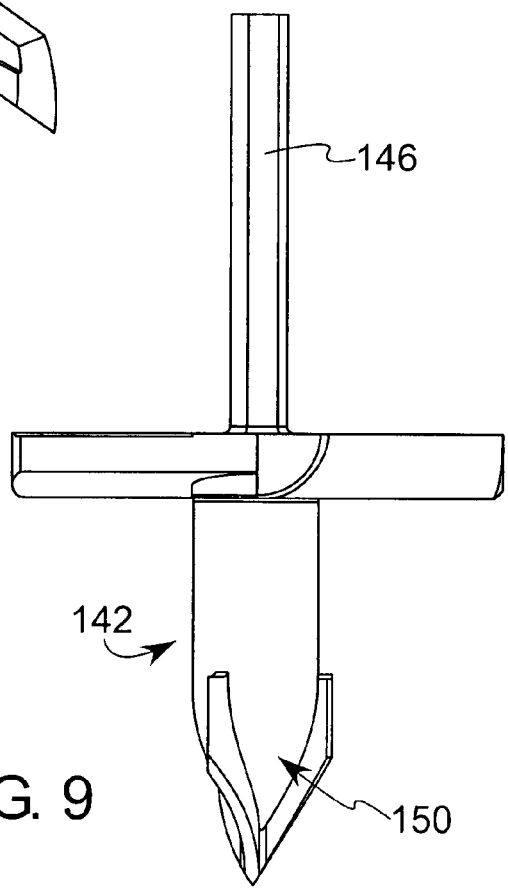
FIG. 9 is a side view illustrating the alternative nose section of FIG. 8.
Figure 10:
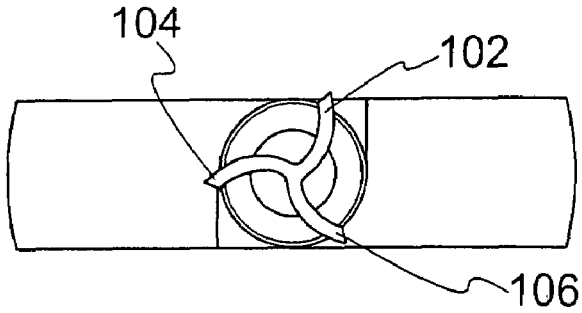
FIG. 10 is an end view illustrating the alternative nose section of FIG. 8.
Figure 11:
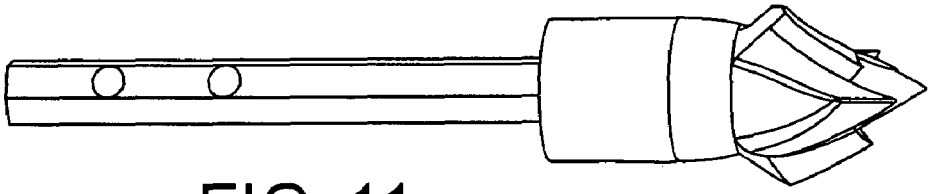
FIG. 11 is a side view illustrating another alternative nose section without a flight cutter.

In an alternative embodiment shown in FIGS. 8-10, the cutting tip 142 and nose shaft 146 are integrated, rather than being separately replaceable. The cutting blades 102, 104 and 106 are fixed to the cutting tip housing 150, such as by slitting the housing 150 and welding or brazing the blades 102-106 therein. The flight cutter 160 is removably mounted to the nose 142 in the same manner as the preferred embodiment described above. Another alternative cutting tip 240 is shown in FIG. 11.

In use, the tool 10 is drivingly linked to a drill or other portable rotary machine through the fitting 100. The drill chuck matingly receives the outer surface of the shaft 130 of the fitting 100 as is common for tools such as drill bits and, once tightened, drivingly links the rotary motor of the drill to the fitting 100, and, thereby, drivingly links to the tool 10. Once the tool 10 is in the drill, any one of the cutting tips described herein is attached to the tool 10 for boring. Attachment of the cutting tip can be performed prior to or after drivingly linking the tool 10 to the drill, but it should be understood that the cutting tip can be changed even while the axle 20 is mounted to the drill. The preferred tool 10 shown in FIG. 1 has the cutting tip 40 drivingly linked to the axle 20 by inserting the shaft 46 in the shaft-receiving bore and tightening of one or more screws (not shown) against the shaft 46.

Once the tool 10 is assembled and mounted in a drill, the blade 43 of the cutting tip 42 is manually placed in contact against a particulate medium, such as sand, dirt, clay, or other soils, for boring. The drill is then switched on to rotate the tool 10 while the user applies a longitudinal force toward the cutting tip 42 in the direction of a hole that is to be formed by the tool 10. The cutting tip 42 enters the medium first, forming a hole the width of the blade 43 and the depth of the combination of the blade 43 and the housing 50.

The flight cutter 60 next contacts the medium and initiates the formation of the larger hole by cutting and breaking up the medium. As the tool 10 progresses into the medium with the longitudinal axis of the axle 20 substantially parallel to the sides of the hole, the flight cutter forms a large diameter hole, and the flights of the auger drive the particulate removed from the medium away from the flight cutter 60 and out of the hole formed. During the rotation of the tool 10 within the hole, debris and soil are cut from the surrounding soil and removed from the hole by the rotation of the auger flight 14 in a conventional manner. The rotating flight 14 pushes the debris and soil from the hole out to the surrounding environment, such as the ground around the hole, as the auger is displaced into and out of the hole a short distance. Rotation continues until the tool 10 bores the hole as deep as possible or desired, and the rotary motion is ceased.

During the first part of the hole-forming operation, the tool 10 and nose 40 are connected together and used alone as shown in FIG. 1. Once the hole is as deep as it can be with the tool 10, an additional structure 510, as described above, can be mounted to the tool 10. The user can add one or more of the structures 510 between the fitting 100 and the tool 10, by disengaging the respective cooperating fasteners, interposing the structure 510 between the fitting 100 and the tool 10, and then engaging the respective cooperating fasteners. Then the longer auger is rotated and the boring process continues.

It will be apparent that different cutting tip shapes can be used instead of those described herein. Furthermore, flight cutters of different shape, and a different number of blades, can be substituted for those shown herein. This is because the detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An improved boring tool having an axle with an outer surface to which a radially inwardly facing edge of a helical flight is attached, an outwardly facing edge of the flight forming a radial periphery of the flight, an axle shaft at a first axle end and a shaft-receiving bore at a second, opposite axle end, the improvement comprising:

a nose removably mounted at the second axle end, the nose comprising a) a multiple-sided nose shaft extending into the shaft-receiving bore, said shaft-receiving bore having a complementary, multiple-sided sidewall for engaging the multiple sides of the nose shaft, thereby drivingly linking the nose to the axle;

b) a cutting tip mounted to the nose shaft, the cutting tip having at least one blade; and c) a flight cutter having an aperture through which the nose shaft extends, thereby removably mounting the flight cutter to the nose shaft, the flight cutter having at least two blades with sharpened edges, wherein a length of the flight cutter is at least as great as a diameter of the radial periphery of the flight and a width of the flight cutter is substantially equal to a diameter of the axle.

2. The tool in accordance with claim 1, wherein at least one fastener extends through the axle into the shaft-receiving bore and seats against the nose shaft, thereby retaining the nose shaft in the shaft-receiving bore.

3. The tool in accordance with claim 2, wherein at least one cavity is formed on the axle shaft for receiving a second fastener, said at least one cavity being spaced longitudinally from, and aligned circumferentially with, said at least one fastener.

4. The tool in accordance with claim 1, wherein the aperture is formed between said at least two blades, said aperture having a multiple-sided sidewall that engages the multiple sides of the nose shaft, thereby drivingly linking the flight cutter to the nose shaft.

5. The tool in accordance with claim 1, further comprising electrical insulating means in the nose for electrically insulating the nose from the axle.

6. The tool in accordance with claim 1, wherein the nose further comprises a) a housing having an interior passage;

b) an insulating body mounted in the passage by an insulating pin extending through the housing and the insulating body, the insulating body being mounted to said nose shaft; and c) an insulating plate mounted in the housing and interposed between an end of the cutting tip and an end of the nose shaft for electrically insulating the nose shaft from the cutting tip.

7. The tool in accordance with claim 1, further comprising a second axle with an outer surface to which a radially inwardly facing edge of a second helical flight is attached, a second axle shaft at one of said second axle's end for drivingly linking to a portable rotatable machine, and a shaft-receiving bore at a second, opposite axle end for receiving the axle shaft of the first axle.

8. The tool in accordance with claim 1, further comprising a drive fitting interposed between a portable rotatable machine and the axle shaft.

9. The tool in accordance with claim 8, wherein the drive fitting further comprises insulating means for preventing electrical current from passing between the axle shaft and the portable rotatable machine.

10. The tool in accordance with claim 8, further comprising a second drive fitting interposed between the nose and the axle, wherein the second drive fitting comprises insulating means for preventing electrical current from passing between the nose and the axle.

11. The tool in accordance with claim 1, wherein one of said at least two blades has a recess that accepts a leading edge of the flight.

* * * * *